United States Patent [19]

Konishi et al.

[11] Patent Number: 5,015,996

[45] Date of Patent: May 14, 1991

[54] SWITCH DEVICE WITH A TROUBLE DETECTING AND INDICATING FUNCTION

[75] Inventors: Keisuke Konishi; Kenji Shinohara, both of Osaka; Norio Iwakiri, Kyoto; Tomofumi Kurashige, Tottori, all of Japan

[73] Assignee: Omron Tateisi Electronics Co., Kyoto, Japan

[21] Appl. No.: 574,083

[22] Filed: Aug. 29, 1990

Related U.S. Application Data

[62] Division of Ser. No. 228,063, Aug. 4, 1988, Pat. No. 4,992,777.

[30] Foreign Application Priority Data

| | | | |
|---|---|---|---|
| Aug. 10, 1987 | [JP] | Japan | 62-200678 |
| Aug. 10, 1987 | [JP] | Japan | 62-200679 |
| Aug. 11, 1987 | [JP] | Japan | 62-201529 |
| Aug. 11, 1987 | [JP] | Japan | 62-201530 |
| Aug. 20, 1987 | [JP] | Japan | 62-207707 |

[51] Int. Cl.[5] ..... G08B 21/00

[52] U.S. Cl. ..... 340/644; 340/604; 200/61.05

[58] Field of Search ..... 340/644, 603, 604, 605; 200/61.04, 61.05, 61.06

[56] References Cited

U.S. PATENT DOCUMENTS

| | | | |
|---|---|---|---|
| 3,571,800 | 3/1971 | Taylor et al. | 340/644 X |
| 4,575,718 | 3/1986 | Ludowyk | 340/644 X |
| 4,762,663 | 8/1988 | Cook et al. | 340/644 X |

*Primary Examiner*—Joseph A. Orsino
*Assistant Examiner*—Jeffery A. Hofsass
*Attorney, Agent, or Firm*—Fish & Richardson

[57] ABSTRACT

A novel electro-mechanical switch device is disclosed which is suitable for use in a factory production line to detect and control the flow of workpieces or articles of manufacture along the line. The switch device includes a pair of switches (101, 102) operative in response to the workpieces passing thereby along the production line, a switch circuit (13) electrically connected to the switches (101, 102), and a moisture detector (15). The pair of switches are so designed that the operation of one switch is delayed with respect to the other. The switch circuit (13) functions in response to the operation of the switches and the moisture detector (15) to provide a warning signal when one of the switches fails to operate within a predetermined delay time with respect to the other switch, as well as when the moisture detector senses a presence of moisture.

4 Claims, 14 Drawing Sheets

SWITCH DEVICE WITH A TROUBLE DETECTING AND INDICATING FUNCTION

This application is a divisional of Ser. No. 07/228,063, filed Aug. 4, 1988 now, U.S. Pat. No. 4,992,777.

BACKGROUND OF THE INVENTION

1. Field of the Invention

This invention relates to a switch device, and more particularly to an improved switch device capable of detecting and indicating operational failure or trouble thereof.

2. Description of the Prior Art

Mechanical switches for controlling the operation of electrical circuits are used in a wide variety of applications. Among those applications is a production or assembly line in an unmanned, automated factory where the switch devices are employed to mechanically detect the passage of various products in the making or workpieces through predetermined process locations along the line for controlling related machineries and mechanisms. Conventionally, limit switches are widely used for this purpose. The limit switch for detecting the passage movement of workpieces or other objects typically includes a self-contained spring mechanism and a movable actuator to be brought into contact with the passing objects. As the approaching object comes into contact with the actuator, the actuator is moved or rotated in one direction. As the object moves away, the actuator is rotated back in the opposed direction under the biasing force of the spring mechanism. This back and forth movement of the actuator drives the limited switch into ON and OFF positions or open and closed positions.

The conventional switches for use in the factory production line, however, have some drawbacks. For example, the associated actuator mechanism is sometimes rendered in immobile due to an increased internal friction. A seal failure in the switch casing permits moisture to penetrate, thereby causing electrical shortings within the switch. Switch contacts being melted together and or accumulation of dusty particles on the switch contacts may also result in a faulty ON-OFF operation of the switch. The malfunction or failure of the limit switch, in turn, leads to the disruption in the operation of the entire production line, and, thus, defective products. In order to correct these situations, the malfunctioning limit switch have to be repaired or exchanged with a new one while keeping the production line at a brief standstill. Shut-down of the production line, however brief, will have an immense influence on the entire manufacturing activity and result in a remarkable reduction of production efficiency.

Various attempts have been proposed to overcome the problems inherent in the prior art limit switch. For example, in order to obtain a reliable ON-OFF switching action, it has been taught to incorporate into the limit switch some means for protecting the switch contact against melting together. It has also been proposed to forcefully separate the melted switch contacts apart. However, there have never been effective solutions proposed for the above mentioned problems such as the switch actuator being made immovable by the increased internal friction, and the dusty materials on or between the switch contacts blocking the normal closing of the contact. Accordingly, any trouble or failure in the operation of the limit switch still costs the costly shut-down of the entire production lines.

SUMMARY OF THE INVENTION

It is, therefore, an object of the invention to provide a novel switch device capable of detecting the occurrence of malfunctions in its switching operation before they grow serious while continuing its switch operation.

It is another object of the invention to provide a novel switch device capable of detecting and indicating a failure of a return movement of the switch.

It is still another object of the invention to provide a novel switch device capable of detecting and indicating a contact failure of the switch.

It is still another object of the invention to provide a novel switch device capable of detecting and indicating an undesirable penetration of moisture into the switch.

Briefly stated, the switch device in accordance with the invention includes a mechanical switch unit, and an associated electrical circuit. The switch circuit functions to provide a control output in response to the switching operating of the switch unit. The switch circuit of the device also is capable of providing a warning signal upon detecting potential hazards to the normal switch operation. The operational hazards to be detected by the switch circuit includes a failure of the switch return movement, a switch contact failure and penetration of moisture into the switch unit.

In accordance with a novel feature of the invention, the mechanical malfunctions are sensed and indicated in their earlier stages well before they grow serious enough to cause the total breakdown of the switch device. In the meantime, the switch device is capable of keeping its uninterrupted operation, awaiting corrective and preventive measures including repair and exchange of affected component parts to be taken at an appropriate time. Thus, when the switch device of the invention is put to use in a factory production line, for example, the occurrence and detection of the functional failures in the switch device does not necessarily lead to and warrant an instant shut-down of the entire production line. Necessary countermeasures can be taken after bringing the line to a standstill at a time when it is deemed to cause least adverse effect on the production and manufacturing operation as a whole, for example, during the nighttime suspension.

BRIEF DESCRIPTION OF THE DRAWINGS

The invention itself, as well as other objects, features and advantages thereof, will best be understood by reference to the following detailed description of particular embodiments, when read in conjunction with the accompanying drawings, wherein.

DESCRIPTION OF THE PREFERRED EMBODIMENTS

The First Embodiment

Figure 1A:
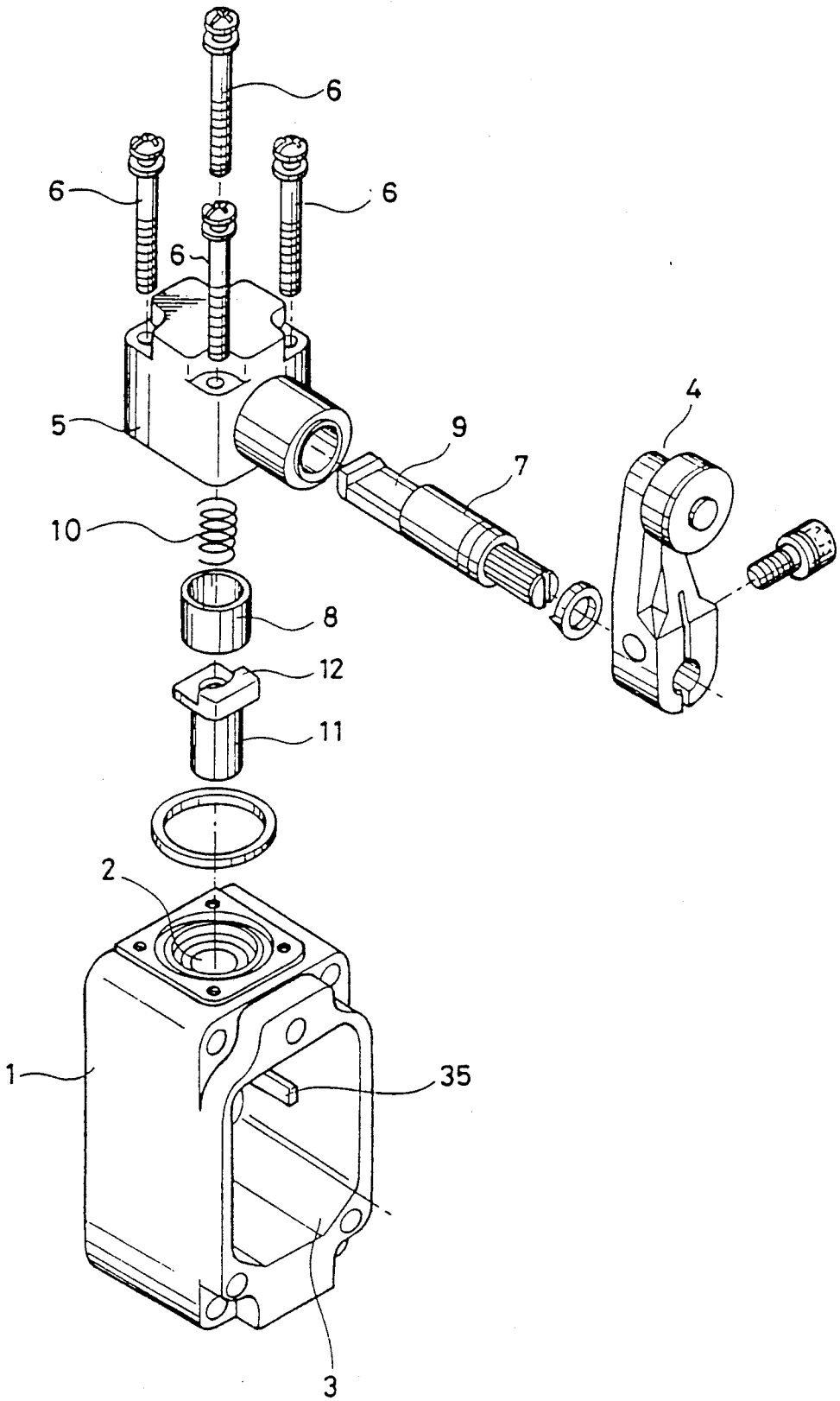
FIGS. 1A and 1B are fragmentary perspective views of a switch device in accordance with one preferred embodiment of the invention.
Figure 1B:
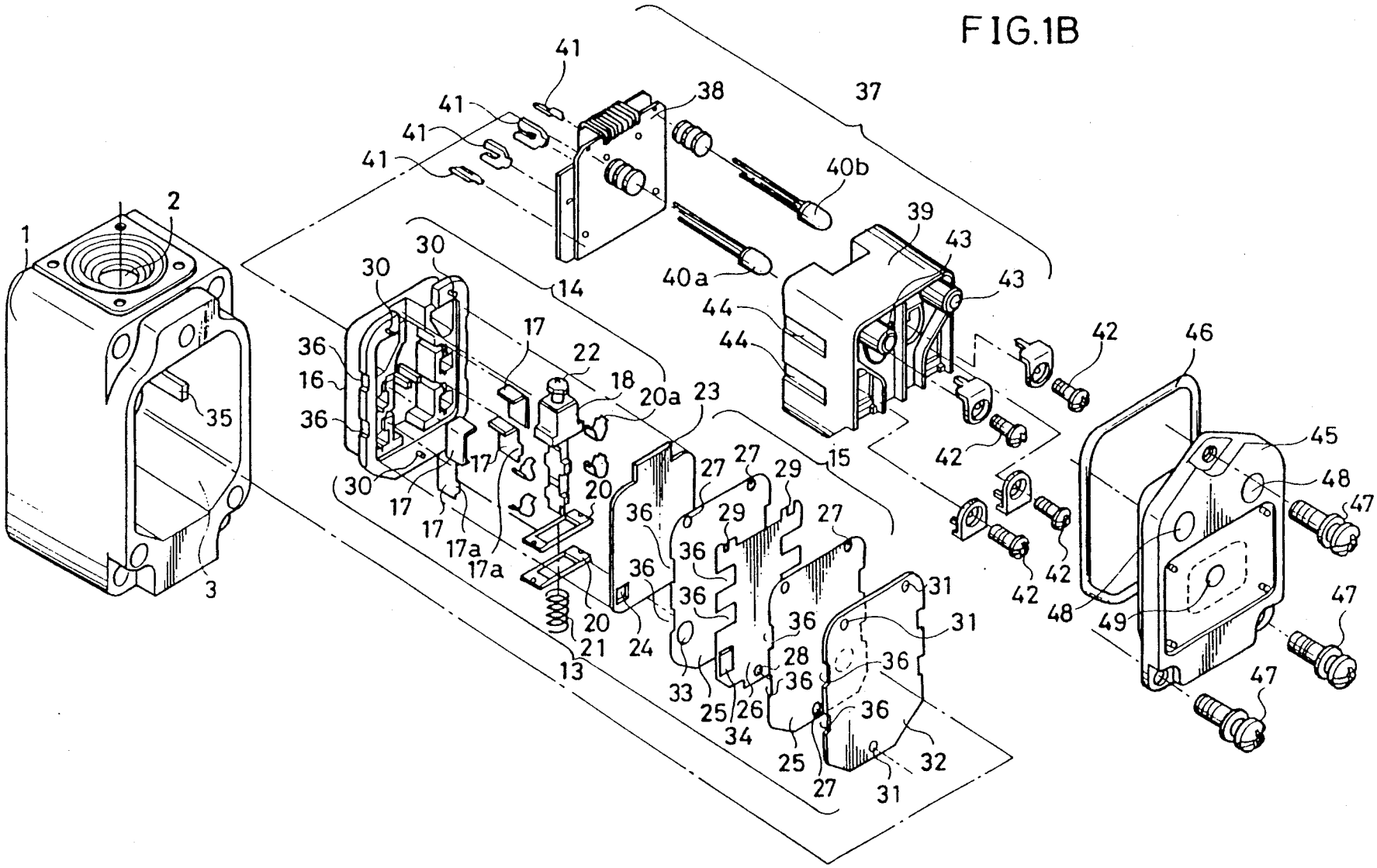
Figure 2:
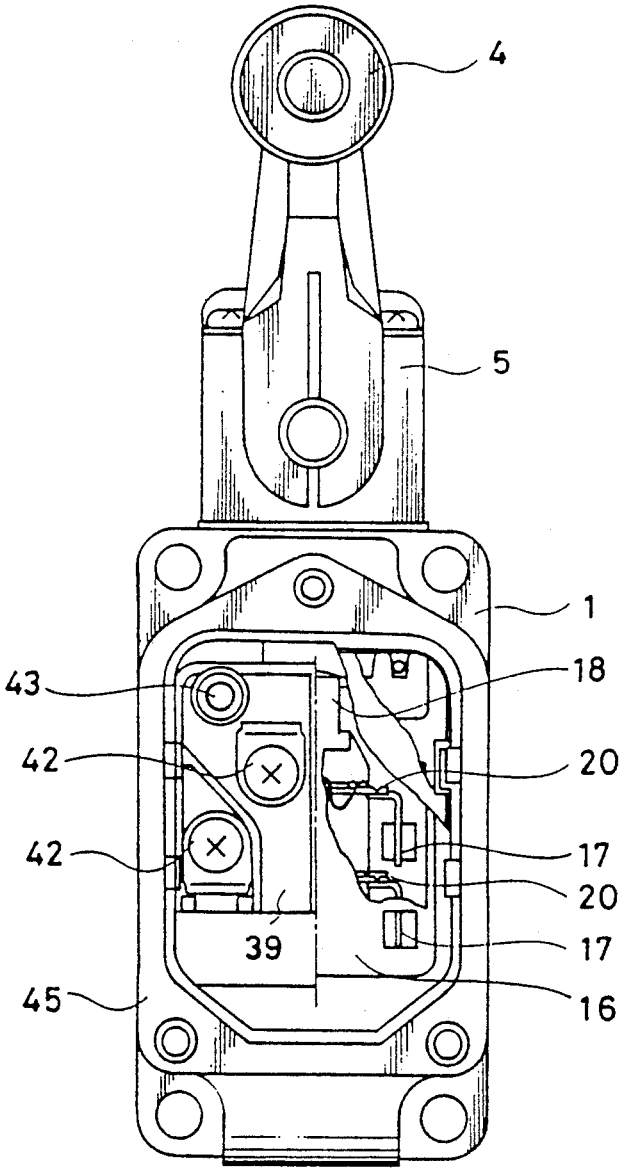
FIG. 2 is a front view, partially cut away, of the switch device shown in FIGS. 1A and 1B.
Figure 6:
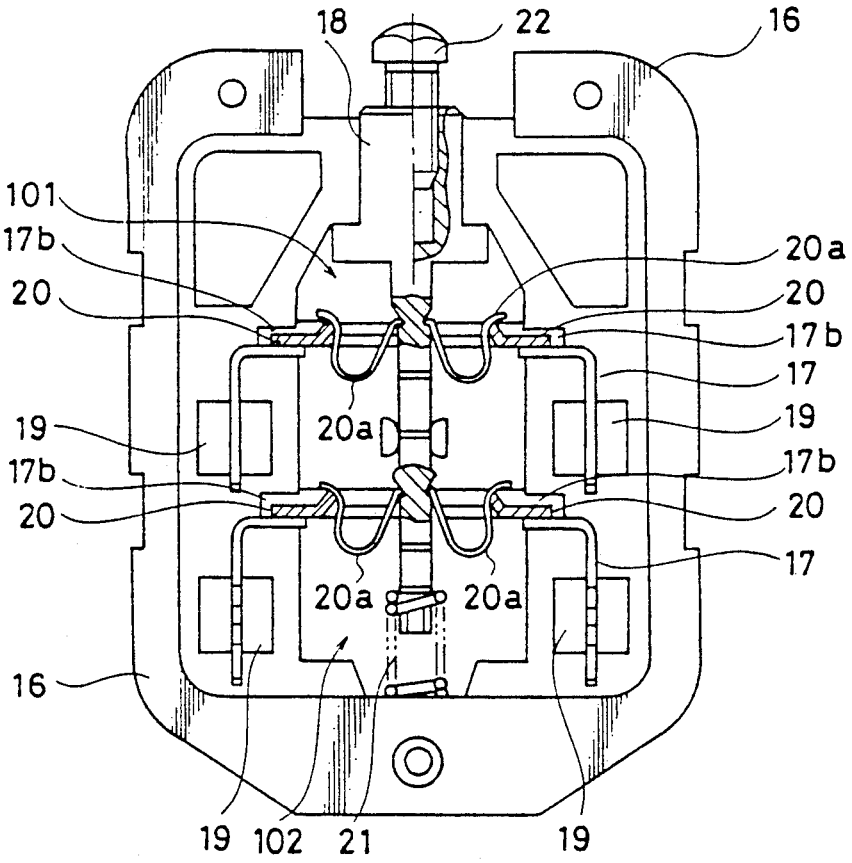
FIG. 6 is a front elevational view of the switch device showing its switch mechanism in detail.

Referring now to FIGS. 1A, 1B and 6, a novel switch device in accordance with one preferred embodiment of the invention is described in detail. The switch device includes a metal casing 1. The casing 1 has a front opening 3 through which various component parts are mounted within the casing. The casing 1 also has a through-opening 2 formed in the top wall thereof. A mounting block 5 for a switch actuator 4 is attached to the top wall of the casing 1 by a plurality of fastening screws 6. The actuator 4 is fixedly mounted on one end of a rotating rod 7, the other end of which is formed into a flattened portion 9. The entire rod 7 is laterally inserted into the mounting block 5 for swinging motion therein. A cup-shaped biasing member 8 together with a coil spring 10 accommodated therein is inserted vertically from below into the mount block 5 so that it sits on the flattened end 9 of the swing rod 7 within the mounting block 5. With the arrangement, the coil spring 10 placed within the biasing member 8 applies downward resilient force onto the flat end 9 of the swing rod 7 and keeps the rod and the associated actuator 4 in their normal positions. A plunger 11 is also vertically inserted into the mounting block 5 after the rotating rod 7 has been fitted into place within the block. Thus, a stepped top end 12 of the plunger 11 is kept in abutting engagement with the underside of the flattened end 9 of the swing rod 7. With this engagement, a rotation of the swing rod 7 moves the plunger 11 axially up and down.

Figure 5:
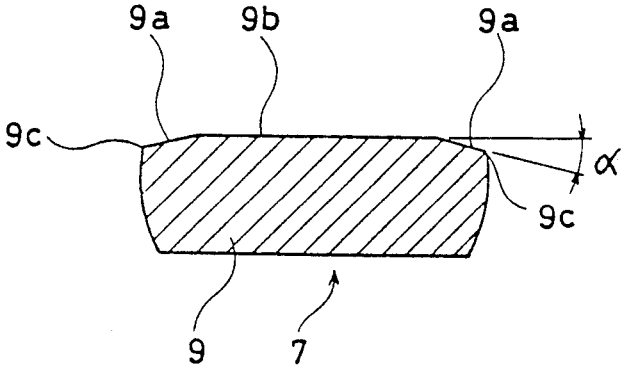
FIG. 5 is an enlarged vertical cross-sectional view of the swing rod taken along V—V of FIG. 4.

As can be seen in FIG. 5, the upper surface of the flattened end 9 of the swing rod 7 is slightly slanted or inclined downwardly from the horizontal along its longitudinally extending side edges 9*a* at a moderate angle of $\alpha$. Thus, the upper face of the flat end 9 comprises a pair of sloped lateral side edges 9*a* and a horizontal center section 9*b* lying between them. The side edge slope $\alpha$ should preferably be around 10 degrees. With this profile, when the switch actuator 4 is in its normal vertical position as shown in FIG. 1A, the flat end 9 of the swing rod 7 is kept in its horizontal position as shown in FIG. 5. In this position, the spring biased member 8 is in biasing engagement with the horizontal section 9*b* of the flat rod end. As the switch actuator 4 rotates in a clockwise or counter-clockwise direction away from its normal vertical position, the swing rod 7 is also rotated in unison with the actuator, bringing either of the two lateral edges 9*a* upwardly away from the positions of FIG. 5. The rotation of the swing rod 7 through the angular distance of $\alpha$ brings either one of the tapered lateral edges 9*a* into contact with the spring biased member 8 depending on the direction of the rotation. Any further rotation of the swing rod 7 brings one side ridge 9*c* of the flat end 9 in engagement with the spring biased member 8. When the member 8 is being pushed upwardly by the side ridge 9*c* of the rod end, the compressed coil spring 10 exerts a greater biasing force on the rod end 9 than it does when the member 8 is in engagement with the lateral edge 9*a*. With this novel arrangement, when the switch actuator 4 is brought back to its normal vertical position from an angularly displaced position after an article of manufacture has struck the actuator and moved away as explained in detail hereinafter, one of the side ridges 9*c* is in engagement with the biasing member 8 during an initial portion of the return movement or stroke of the switch actuator 4. As the actuator rotates further back toward its normal position, the inclined side edge 9*a* comes into contact with the biasing member 8 followed by the horizontal section 9*b* during the rest of the return stroke. This means that the biasing force of the coil spring 10 applied to the swing rod 7 via the member 8 to urge the switch actuator 4 back to its normal position abruptly decreases during the return movement of the actuator. Thus, the swing rod 7 with a unique upper surface profile at its end comprises means for providing a abruptly decreasing biasing force for slowing down the return motion of the actuator.

Figure 3:
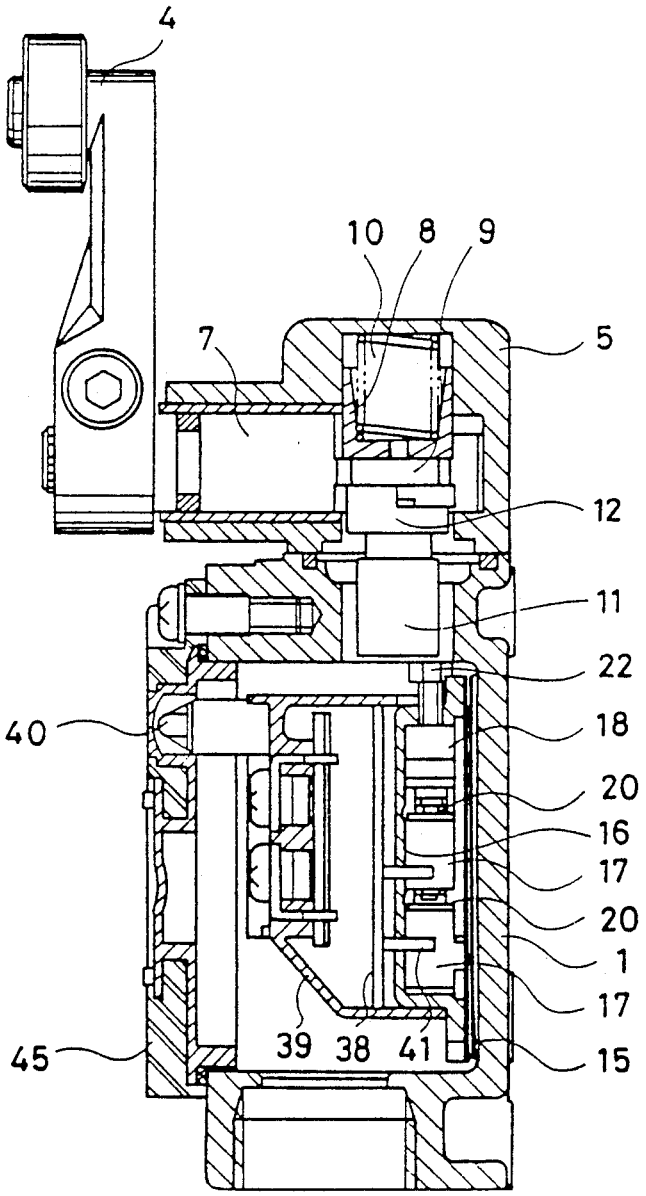
FIG. 3 is a longitudinal cross-sectional view of the switch device shown in FIG. 1A and 1B.

As illustrated in FIG. 1B, the switch device in accordance with the present invention includes a switch assembly 13 comprised of a switch unit 14 and a moisture detecting unit 15. The switch unit 14 has an electrically insulating base member 16 made of a suitable synthetic resin material. The base member 16 fittingly accommodates a pair of upper fixed contacts 17 and a pair of lower fixed contacts 17. A movable axial member 18 is positioned within the insulating base 16 for vertically upward and downward movement between its uppermost and lowermost positions. The lower pair of the fixed contacts 17 have protrusions or projections 17*a* formed thereon. As more clearly seen in FIG. 6, the upper and lower pairs of fixed contacts 17 have their mating movable contacts 20. The upper and lower movable contacts 20*b* are positioned within the insulating base 16 in facing relations with the upper and lower pairs of fixed contacts 17, and are operatively connected to the axial member 18 via resilient leaf springs 20*a*. The axial member 18 has an adjusting screw 22 attached at its top end and a coil spring 21 at its lower end. The coil spring 21 is held in compression between the lower end of the axially movable member 18 and the bottom of the insulating base 16, and functions to resiliently urge the member vertically upwardly into the upper position shown in FIG. 6. When assembled in place, the adjusting screw 22 at the top end of the axial member 18 is held in engagement with the lower end of the the plunger 11 (FIG. 3). A transparent closure member 23 is for covering the insulating base 16, and has a pair of openings 24 formed spaced apart at the lower corners thereof. When the closure member 23 is put in place within the base 16, the projections 17*a* formed on the lower fixed contacts 17 extend outwardly through these openings 24. As shown in FIG. 6, the insulating base 16 is also formed with upper and lower pairs of openings 19 at locations corresponding to the upper and lower pairs of the fixed contacts 17, respectively. Terminal lags or connectors 41 (FIG. 1B) extend through the base openings 19 for making electrical connection with the fixed contacts 17 as will be explained hereinbelow. Having described thus far, it is noted that the upper fixed contacts together with its mating movable contact forms an upper or first switch 101, while the lower fixed contacts together with its mating movable contact comprises a lower or second switch 102.

Referring further to FIG. 6, the upper and lower movable contacts 20 are held in place within slots or grooves 17*b* formed in the wall of the insulating base 16. As described hereinabove, the movable contacts 20 are operatively connected to the axial member 18 via the leaf springs 20*a*. As the movable axial member 18 is pushed downward against the biasing force of a coil spring 21 from its uppermost position of FIG. 6, the curved leaf springs 20*a* act to snap up the movable contacts 20 out of engagement with the corresponding fixed contacts 17. In order to allow for the movable contacts 20 to pop up away from the fixed contacts 17 under the resilient force of the leaf spring 20*a*, both the upper and lower slots 17*b* have vertical dimensions or widths at least greater than the thickness of the leaf springs. In accordance with one feature of the invention, the lower slot is designed to have a vertical dimension greater than the upper slot. As a result, when the axial member 18 is depressed downward from its uppermost position of FIG. 6 to its lowermost position to snap the movable contacts 20 upwardly away from the fixed contacts 17, the lower movable contact travels a greater distance than does the upper movable contact before they come to a standstill. Meanwhile, as the axially movable member 18 is urged upward from its lowermost position back to its uppermost position under the biasing force of the coil spring 21, both the upper and lower movable contacts 20 are brought down into contact with the corresponding fixed contacts 17 by the snap-acting leaf springs 20*a*. It should be pointed out at this point that, in accordance with this invention, the upper and lower switches 101, 102 are designed such that there is produced some delay in closing action between these switches. More specifically, while the switches 101, 102 are simultaneously driven back toward the closed position by the axially movable member 18, the closing of the lower switch 102 takes place later than the upper switch 101. In this connection, the snapping back of the movable contact 20 into engagement with the mating fixed contact 17 occurs when the point of connection between the leaf spring 20*a* and the axial member 18 at one end of the leaf spring moves vertically past the point of joint between the leaf spring 20*a* and the movable contact 20 at the other end of leaf spring in the course of the upward return movement of the axial member. Thus, the vertical displacement or distance between the opposite ends of the leaf spring dictates the time when the movable contact 20 is snapped back into engagement with the corresponding fixed contact 17. The greater is the vertical displacement, the longer it takes for the end of the leaf spring 20*a* joined to the axial member 18 to move past the level of the other end of the leaf spring 20*a* connected to the movable contact 20 while the axial member is driven back to its uppermost position. In this regard, it should be remembered that the greater vertical dimension of the lower slot 17*b* for accommodating the lower movable contact as compared to that of the upper slot permits the lower movable contact to travel upwardly a greater distance than the upper movable contact when driven by the downwardly moving axial member 18. As a result of this arrangement, when the axial member 18 pressed down into its lowermost position, a greater vertical displacement is secured between the opposite ends of the leaf spring associated with the lower movable contact than between the opposite ends of the leaf spring connected to the upper movable contact. Consequently, as the axial member 18 travels upwardly back into its uppermost position, the upper movable contact is first snapped back into engagement with the fixed contact, followed by the lower movable contact being thrown into engagement with the corresponding fixed contact after a certain time interval, providing a desired delay of the switch-closing action between the upper and lower switches 101 and 102.

Referring again to FIG. 1B, the moisture detecting unit 15 of the switch assembly 13 includes a pair of electrode plates 25 and an insulating sheet 26 sandwiched between them. The electrode plates 25 have three aperture 27 formed therein at positions corresponding to pin projections 30 provided on the insulating base 16. The insulating sheet 26 also has an aperture 28 formed at its bottom and a pair of cutouts 29, through which projecting pins 30 on the insulating base 16 extend when the insulating sheet 26 is assembled in place together with the electrode plates 25 onto the base 16 over the transparent closure 23. An outer cover 32 with similarly formed apertures 31 fixedly holds the electrode plates 25 and the insulating sheet 26 attached to the insulating base 16.

When thus assembled, the electrode plates 25 are electrically isolated from each other by the insulating sheet 26. It is noted that one of the pair of electrode plates 25 is provided with an opening 33 at a position corresponding to the projection 17*a* on one of the lower fixed contacts 17, whereas the other of the electrodes plate 25 is formed with an opening 33 at a position corresponding to the similar projection 17*a* on the other of the lower fixed contacts 17. Likewise, a pair of openings 34 are made in the insulating sheet 25 at positions corresponding to the projections 17*a* on the lower fixed contacts 17. In the assembled state, one of the fixed contact projections 17*a* extends through one opening 24 in the transparent closure 23 into engagement with the electrode plate 25 which lies closer to the lower fixed contacts 17, while the other contact projection 17*a* extends through the opening 24 in the transparent closure 23, the opening 33 in the closer electrode plate 25 and the opening 34 in the insulating sheet 26 into engagement with the other electrode plate 25 which is positioned remote from the lower fixed contacts 17. In this regard, there is no substantial reason to form the opening 33 in the remote electrode plate 25. However, in order to render the pair of electrode plates 25 interchangeable with each other, the opening 33 is formed in both electrodes plates.

The switch assembly 13 is inserted through the front opening 3 into the casing 1 to be held in place therein with the outer cover 32 sitting on the bottom of the casing. The casing 1 has guide projections 35 formed on its inner sidewalls. Mating guide notches 36 are provided in the side edges of the insulating base 16, the electrode plates 25, the insulating sheet 26 and the outer cover 32. The guide projections 35 together with their mating guide notches 36 facilitate an easy and reliable mounting of the switch assembly 13 within the casing 1. After the switch assembly 13 has been mounted in place, the adjusting screw 22 is suitably rotated to regulate the angular range through which the switch actuator 4 swings back and forth.

The switch device according to the invention further includes an electrical circuit assembly 37. The circuit assembly 37 comprises a print circuit board 38 on which various circuit components are to be provided, and a mounting block 39 for the print circuit board. The circuit board 38 has two pairs of terminal connectors 41 attached at its surface facing toward the insulating base 16 in an assembled state. The terminal connectors 41 are electrically coupled to predetermined points in the printed circuit (not shown) formed on the opposite surface of the circuit board away from the insulating base 16. A pair of light emitting diodes or LEDs 40*a*, 40*b* are provided on the circuit board 38 for purposes explained later. When the circuit board 38 is assembled into the mounting block 39, the pair of LEDs 40*a*, 40*b* fit into a corresponding pair of cylindrical openings 43 formed in the mounting block. This arrangement enables a visual observation of whether the LEDs are conducting into emitting light. Two pairs of input terminals 42 are fastened to the mounting block 39 on its face remote from the circuit board 38, and they make electrical contact through the block with predetermined points in the printed circuit on the board 38. The mounting block with the circuit board 38 assembled into place, is inserted into the casing 1 through the front opening 3 until it fits over the insulating base 16 of the switch assembly 13. During this inserting procedure, the lateral guide projections 35 cooperate with corresponding guide grooves 44 formed along the sidewalls of the mounting block 39 to lead the block into place within the casing. As the mounting block 39 is fitted over the insulating base 16, the two pairs of terminal connectors 41 in the circuit assembly 37 extend through the corresponding rectangular openings 19 in the base and make electrical connection with the corresponding fixed switch contacts 17 (FIG. 6).

Referring again to FIG. 1B, in order to close the front opening 3 of the casing 1, a front cover 45 is fastened to the switch casing 1 by means of screws 47 with a generally rectangular packing ring 46 positioned between the casing 1 and the cover 45. It is noted that a pair of circular windows 48 are formed in the front cover member 45 at locations corresponding to the cylindrical openings 43 in the mounting block 39 for the same purpose as described. Following the general practice in the industry, a name plate 49 is attached to the front cover 45.

Figure 7:
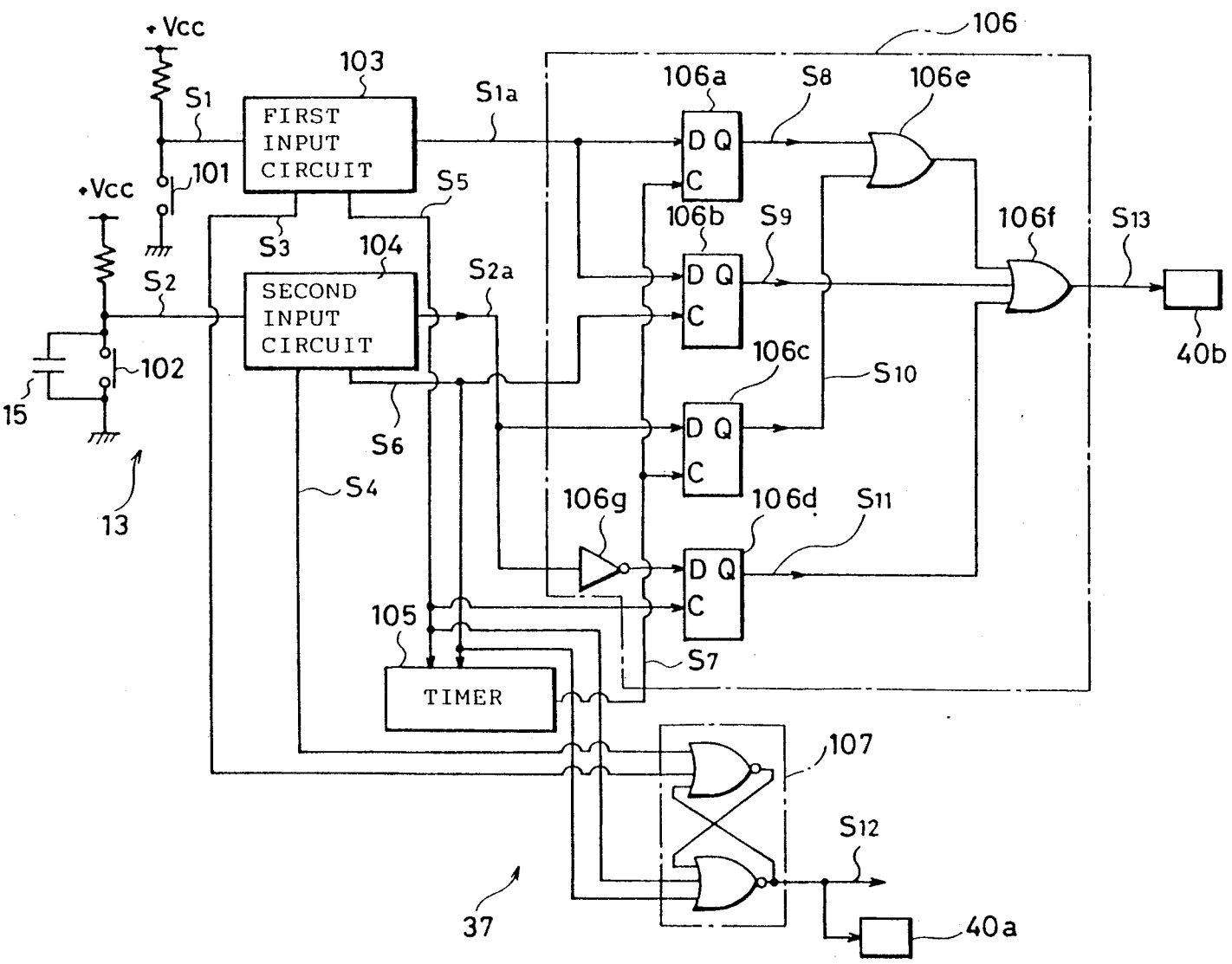
FIG. 7 is a schematic diagram showing a switch circuit incorporated in the switch device of FIGS. 1A and 1B.

Referring now to FIG. 7, the switch circuitry 37 incorporated in the switch device in accordance with the invention is described.

As hereinabove explained, the upper or first switch 101 and the lower or second switch 102 are both in operative relations with the switch actuator 4, and their ON-OFF switching actions are under control of the actuator. The first switch 101 comprises the upper pair of fixed contacts 17 and the upper movable contact 20, while the second switch 102 comprises the lower pair of fixed contacts 17 and the lower movable contact 20. As the switch actuator 4 rotates or moves angularly in a clockwise or counter-clockwise direction away from its vertical position, the switches 101 and 102 are simultaneously driven into their open or OFF position. When the actuator 4 moves back to its vertical position, the switches 101 and 102 are driven back into the closed or ON positions again simultaneously. However, the switches 101 and 102 are so designed that the actual closing of the switch 102 is delayed a predetermined amount of time with respect the closure of the switch 101. The first switch 101 produces a first switch signal S1 while it is kept open, and the second switch 102 provides a second switch signal S2 while kept open.

The switch circuitry 37 includes a first input circuit 103 connected to the first switch 101, and a second input circuit 104 coupled to the second switch 102. The moisture detecting unit 15 is electrically connected in parallel with the second switch 102. The switch signal S1 is produced while the first switch 101 is in its open position and it is supplied to the first input circuit 103. As can be seen in FIG. 8A, the leading edge of the signal S1 triggers the input circuit 103 into generating an output pulse S3, whereas the trailing edge of the same signal S1 triggers the input circuit 103 into generating an output pulse S5. Thus, the output pulses S3 and S5 of the first input circuit indicate opening and closing of the first switch 101, respectively. In a similar manner, the switch signal S2 produced by the second switch 102 while the switch is in its open position is fed to the second input circuit 104. The leading edge of the switch signal S2 triggers the second input circuit into generating an output pulse S4 which indicates the second switch is opened, whereas the trailing edge of the switch signal S2 triggers the second input circuit into generating an output signal S6, indicating the second signal is closed back. The first input circuit 103 also generates an output signal S1*a* in response to and similar in waveform to the switch signal S1. Likewise, the second input circuit 104 produces an output signal S2*a* in correspondence with the switch signal S2.

The switch circuitry 37 also includes a timer circuit 105 coupled to both the first and second input circuits 103 and 104. The timer circuit 105 starts operating in response to the output pulse S5 from the first input circuit indicating the closing of the first switch 101. The timer 105 stop its normal timing operation upon receipt of the output pulse S6 from the second input circuit indicating that the second switch 102 has been closed. As explained previously, there is a preselected delay in the closing of the switch contacts between the first switch 101 and the second switch 102. Thus, under normal operating conditions, when the switches are to be thrown back into their closed positions, the first switch 101 is initially closed at t1 followed by the closure of the second switch 102 at t2 with the preselected time delay t1-t2. The initial closing of the first switch triggers the timer circuit 105 into operation, whereas the subsequent closure of the second switch drives the circuit out of operation as long as the closing of the second switch takes place within the predetermined delay time with respect to first switch. If the second switch 102 failed to close within the selected time delay, the timer circuit continues its operation since the terminating signal S6 is not applied thereto by the second switch through the second input circuit 104. This failure of the second switch represents that a potentially undesirable situation is occurring for the production line and it should be attended to. In order to indicate the operational failure or trouble in the second switch 102, the timer circuit 105 is provided with an overtime warning function. According to the function, the timer circuit operates to produce an overtime signal S7 when a preset overtime T has passed after the circuit is triggered into operation by the pulse signal S5 produced upon the first switch 101 being closed. In this connection, it should be noted that the length of overtime T is set to be greater than the interval of the delay time t1–t2 between the first and second switch closures. The maximum length of overtime interval T is determined by factors involving the operating conditions of the production line.

The switch circuitry 37 further includes a trouble detecting and indicating circuit 106. The circuit 106 comprises a first D-type flip-flop 106*a* connected to the output of the first input circuit 103, and a second D-type flip-flop 106*b* coupled to the second input circuit 104 as well as to the first input circuit 103. The second flip-flop 106*b* functions as a contact failure detector and produces a trouble indicating signal S9 in response to the pulse signal S6 supplied thereto by the second input circuit when contact failure is caused in the first switch 101. A third D-type flip-flop 106*c* is coupled to the output of the second input circuit 104 as well as the timer circuit 105. The third flip-flop 106*c* also acts as a contact failure detector and produces a trouble indicating signal S10 in response to an overtime signal S7 supplied thereto by the timer circuit 105 when contact failure is found in the second switch 102. A fourth D-type flip-flop 106*d* in the circuit 106 is connected to the first input circuit 103 and serves as a water-seal failure detector. Thus, the flip-flop 106*d* provides a trouble indicating signal S11 in response to the pulse signal S5 supplied thereto by the first input circuit 103 when the moisture detecting unit 15 senses the penetration of moisture or water. The outputs of the first and third flip-flop 106*a* and 106*c* are connected to OR gate 106*e*, which produces a logical sum of the outputs from the first and third flip-flops. A second OR gate 106*f* provides a logical sum of the outputs from the first OR gate 106*e*, and second and fourth flip-flops 106*b* and 106*d*. An inverter 106*g* is inserted between the second input circuit 104 and the fourth flip-flop 106*d*.

The switch circuitry 37 further includes a RS-type flip-flop 107. The flip-flop 107 is connected to the first and second input circuits 103 and 104, and generates an output signal S12 upon receiving an output signal S3 from the first input circuit 103 or an output signal S4 from the second input circuit 104. The generation of the output signal S12 is terminated by the signal S5 from the first input circuit or by the signal S6 from the second input circuit.

Normal Switching Operation

Referring again to FIGS. 1–6, mechanical operation of the switch assembly 13 under normal conditions is now described.

Let us now assume that a workpiece on a production line is moving past the switch device of the invention. As the work piece approaches the switch device, it comes into engagement with the switch actuator 4 and rotates it about 45 degrees in one direction, clockwise or counter-clockwise depending on the direction in which the workpiece travels. This angular rotation of the switch actuator 4 causes the swing rod 7 to rotate in unison with the actuator against the biasing force of the coil spring 10. As the swing rod 7 rotates, the plunger 11 in mechanical engagement with the flattened end 9 of the swing rod is driven axially downward. The downwardly driven plunger 11, in turn, moves the axial switch member 18 downward via the adjusting screw 22 from its upper position of FIG. 6 to its lower position against the biasing force of the coil spring 21. As the switch member 18 is moved downward, the upper and lower leaf springs 20*a* snap up the upper and lower movable contacts 20 away from the corresponding upper and lower pairs of fixed contacts 17, thereby throwing the switches 101 and 102 open.

As the workpiece passes along out of contact with the switch actuator 4, the actuator is swung back toward its initial vertical position under the biasing force of the coil spring 10. This backward rotation of the actuator 4, thus of the swing rod 7 allows the plunger 11 to move vertically upward. Consequently, the reciprocating switch member 18 is driven vertically upward back to its upper position by the biasing force of the compressed coil spring 21. The upwardly moving switch member 18 initially snaps the upper movable contact 20 down into engagement with its corresponding fixed contacts 17, thus closing the first switch 101. Thereafter, the switch member 18 swings the second switch 102 back into its closed position in much the same way with the preselected time delay in regard to the first switch.

The operation of the switch circuity 37 for the normal switch operation is explained next having reference to FIG. 8 together with FIG. 7.

As the first switch 101 is thrown open at time t0, a switch signal S1 is provided to the first input circuit 103 from a power source Vcc. The supply of the signal S1 continues as long as the first switch 101 is in its open position. The first input circuit 103 generates a first output pulse S3 at t0 in response to the switch signal being applied thereto. The input circuit 103 also produces a second output pulse S5 at t1 upon the termination of the switch signal S1. Thus, the first and second output pulses S3 and S5 are indicative of the OFF and ON switching actions of the first switch 101, respectively. In a similar manner, as the second switch 102 is thrown open at t0, a switch signal S2 is fed to the second input circuit 104 from a power source Vcc. The supply of the switch signal S2 is discontinued when the second switch is thrown back to its closed position at t2. The second input circuit 104, which is responsive to the switch signal S2, produces a first output pulse S4 at t0 upon receipt of the signal S2, and a second output pulse S6 at t2 upon the termination of the signal S2. Thus, the output pulses S4 and S6 indicate, respectively, the opening and closing of the second switch 102.

Under the circumstances, the output pulse S5 from the first input circuit 103 triggers the timer circuit 105 into operation at t1, and the output pulse S6 from the second input circuit 104 drives the timer circuit out of operation at t2. There is no possibility that the overtime signal S7 is generated by the timer circuit 105 since the operation thereof has been discontinued by the application of the output signal S6. In the absence of the overtime signal S7, the D-type flip-flops 106*a* and 106*c* in the trouble detecting and indicating circuit 106 remain inactive. Thus, the circuit 106 does not provide a failure indicating output signal such as a signal S13. Meanwhile, the pulse signal S3 from the first input circuit 103 and the pulse signal S4 from the second input circuit, which have been produced when the first and second switches 101 and 102 are snapped open, are being applied to the RS-type flip-flop 107. Thus, the flip-flop 107 generates an output signal S12 for controlling the operation of the production line. The output signal S12 also causes the LED 40*a* to conduct into emitting light, which indicates the system is under operation.

Non-normal Switching Operation I

Figure 8B:
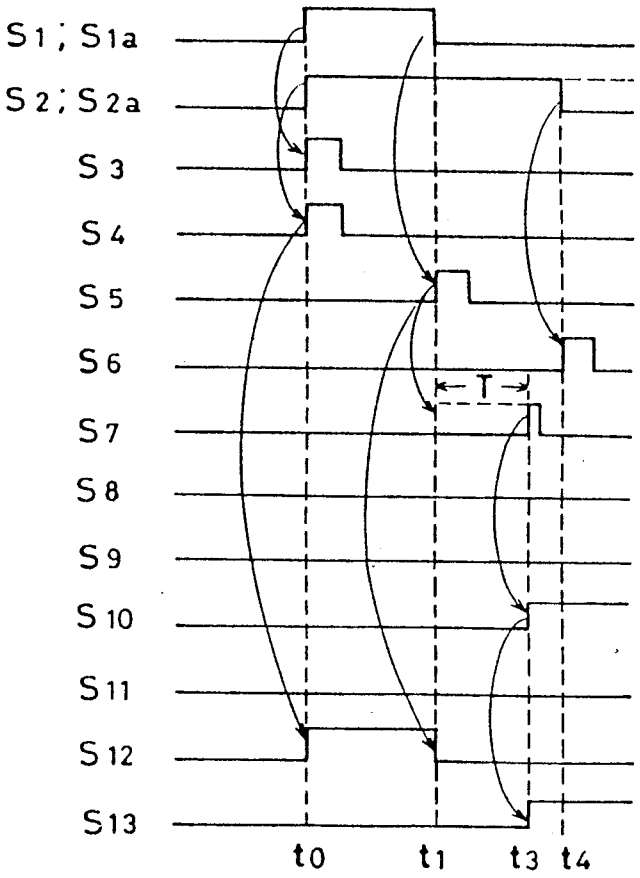
FIGS. 8A, 8B, 8C and 8D are timing diagrams useful for understanding the operation of the switch circuit of FIG. 7.
Figure 8A:
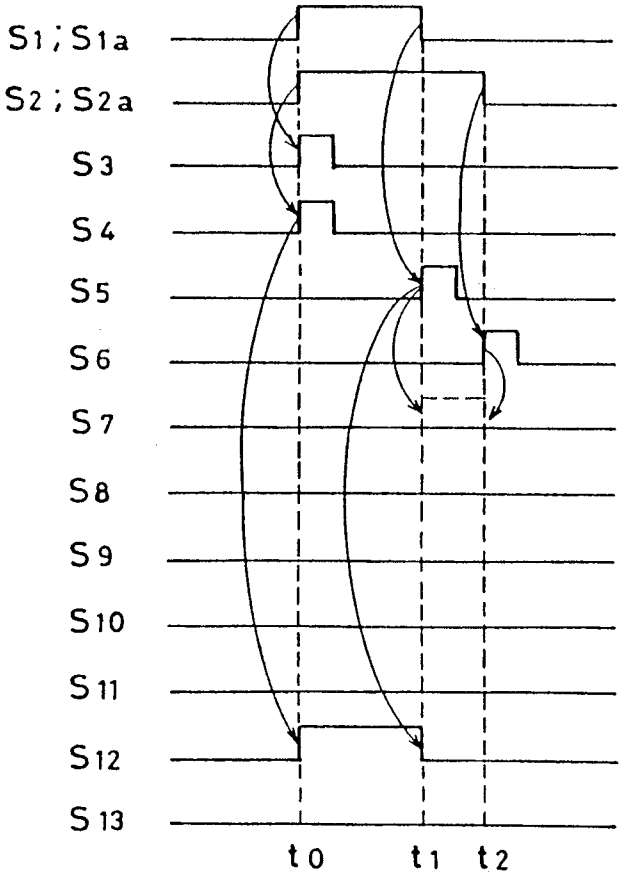

The Second Switch Fails to Return [FIG. 8B]

The operation of the switch circuitry 37 is described in connection with a malfunctional situation where the second switch 102 of the switch assembly 13 returns to its closed state after the lapse of the specified delay time or completely fails to return to the closed state. Such operational failure may result from the switch actuator being unduly slowed down or halted halfway through its return movement due to an unexpected increase of the internal friction within the switch device, or else because dust particles or other foreign matters built-up on and/or between the switch contacts, particularly on the fixed switch contacts.

Reference is made to FIG. 8B. It is assumed that, under the circumstances, the second switch 102 is closed subsequent to the first switch 101 but later than the termination of the overtime interval T or t1—t3 beyond the usual delay of t1—t2 in the timer circuit operation, for example, at t4 or the second switch would never be able to return to the closed position. In either case, the timer circuit 105, being initiated by the pulse S5 from the input circuit 103 at t1, applies an overtime output pulse S7 to both the first and third flip-flops 106*a* and 106*c* at t3. It is noted here that the third flip-flop 106*c* is also being supplied with a high-level output signal S2*a* at its input D from the second input circuit 104. Thus, the application of the overtime pulse S7 to its clock input C at t3 triggers the third flip-flop 106*c* into providing an output S10 which, in turn, is fed through the OR gate 106*e* to the OR gate 106*f*. Upon receiving the output, the OR gate 106*f* generates a trouble indicating output S13 and supplies it to the LED 40*b*, which is rendered conductive to provide a visual warning that switching failure is occuring.

While the LED 40*b* is generating a visible warning, the production line under the control of the switch device of the invention continues to operate properly because the normal switching function of the first switch 101 produces pulses S3 and S5 at times t0 and t1, respectively, and supplies them to the RS flip-flop 107. The RS flip-flop, in turn, provides a control output S12 for the normal operation of the production line.

Locating the cause of malfunction and taking counter measures thereagainst including the repair and, when necessary, the exchange of the switch components and the actuator may suitably be done after bringing the production line to a halt at an appropriate time.

Figure 4:
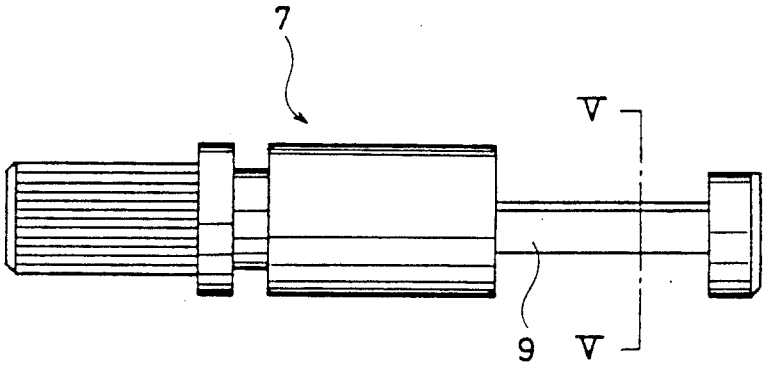
FIG. 4 is an enlarged elevational view of a swing rod in the switch device shown in FIGS. 1A and 1B.

As hereinabove described in connection with FIGS. 4 and 5, the upper face of the rod end 9 comprises a pair of inclined side edges 9*a* and the horizontal center section 9*b* between them. During the return trip of the switch actuator 4, thus of the switch rod 7 under the force of the coil spring 10 within the cup-shaped biasing member 8, linking engagement between the biasing member 8 and the rod end 9 is first being made at one of the side ridges 9*c* until the first switch 101 is snapped back into its closed condition. Thereafter, the engagement is switched over at the neighboring side edge 9*a*, allowing the compressed coil spring 10 to extend axially. The biasing force being applied to the swing rod 7 thus decreases substantially and abruptly in the course of its return movement. The reduced biasing force on the swing rod makes it more sensitive or vulnerable to a slighter friction caused within the switch mechanism. This makes possible earlier detection and warning of potential hazards to the normal operation of the switch device, thus of the entire production line.

Non-normal Switch Operation II

Figure 8D:
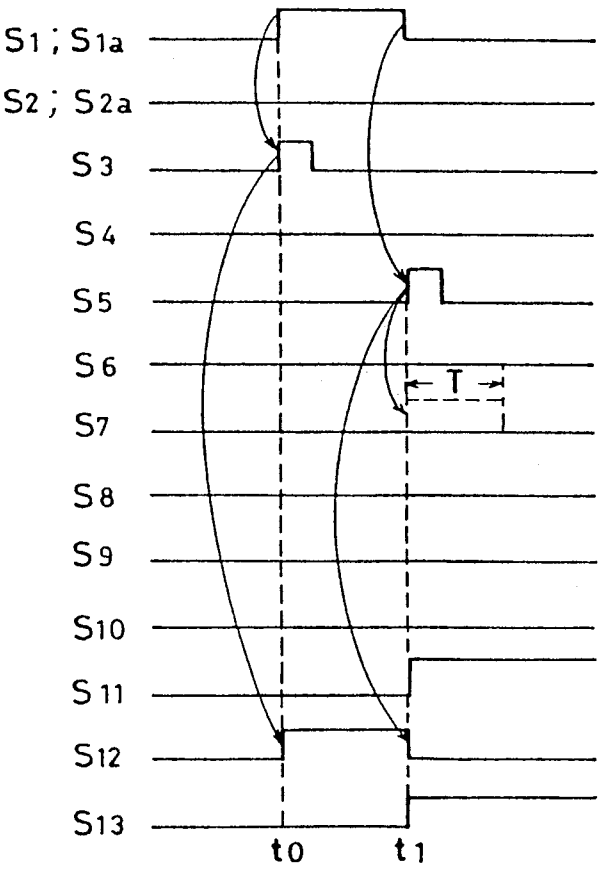
Figure 8C:
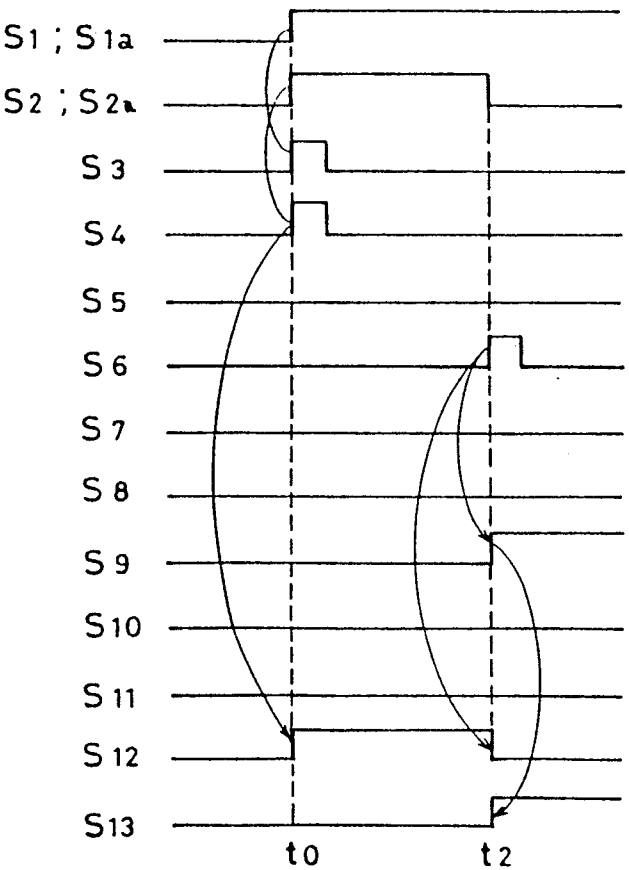

The First Switch Fails to Return [FIG. 8C]

Referring to FIG. 8C, the operation of the switch circuitry 37 for the switch device is described in an other malfunctional situation where the first switch 101 of the switch assembly 13 is prevented from being closed back due to the presence of dusty particles or other foreign matters on and/or between its switch contacts.

In this situation, since the first switch 101 is being kept open, providing a continuous high-level signal S1, the first input circuit 103 fails to generate a pulse S5 which is to be produced when the first switch is closed back. However, the circuit 103 does supplies a corresponding high-level output S1a to the inputs D of the first and second flip-flop 106*a* and 106*b*. In the absence of the clock pulse S5, the timer circuit 105 remains inoperative. The second switch 102 is closed normally back at t2, in response to which the second input circuit 104 produces and supplies the pulse S6 to the input C of the second flip-flop 106*b*. Note that the high-level output signal S1a has been applied to the output D of the second flip-flop. Thus, upon receiving the pulse S6, the second flip-flop 106*b* produces a high-level output S9 at t2, which is transferred to the OR gate 106*f*. The OR gate, in turn, provides a failure indicating signal S13 to turn on the LED 40*b* into emitting a warning signal in a similar manner as explained previously.

While switching failure is caused in the first switch 101, the second switch 102 operates trouble-free. The second input circuit 104 feeds the normal pulse S4 to the RS flip-flop 107, which generates the in-operation signal S12 with concurrent light emission of the LED 40*a*. The production line keeps running normally under the control of the second switch 102.

The malfunctioning situation listed above have been described based on the assumption that the switch device is free from-moisture or water penetration, and, accordingly, the moisture detecting unit 15 remains out of operation. However, for some reason or other, if moisture finds its way into the switch casing 1 in deleterious amounts enough to short-circuit the pair of electrode plates 25, then the moisture detector 15 performs its function as follows.

Non-normal Switch Operation III

Moisture Penetration Causes Switching Failure [FIG. 8D]

As moisture or water including electrically conductive liquid finds its way into the switch case 1, and the water trapped within the casing short-circuits the pair of electrode plates 25, each in engagement with the projection 17*a* formed on the lower fixed contact 17. As a result, a direct electrical path is established between the pair of lower fixed contacts 17 which belongs to the second switch 102. The short-circuited second switch 102 does not provide any output signal since it is never broken open electrically. In the absence of a high-level input, the second input circuit 104 produces and supplies a low-level output to the inverter 106*g*, which, in turn, keeps feeding a high-level output to the input D of the fourth flip-flop 106*d* through its signal inverting function. Responsive to the first switch 101 being closed back at t1, the first input circuit 103 generates and supplies an output pulse S5 to the input C of the fourth flip-flop 106*d*. Thus, at t1, the flip-flop 106*d* produces a high-level output signal S11 which is indicative of switch malfunction. Upon receiving this high-level signal S11, the OR gate 106*f* generates a trouble indicating signal S13, which, conducts the LED 40*b* into emitting a visible warning. The timer circuit 105 is clocked into operation at t1 by the pulse signal S5 upon the normal closing of the first switch 101. However, the short-circuited second switch 102 fails to provide a pulse for shutting off the timer operation. In the absence of the shut-off pulse, the timer circuit 105 is automatically clocked out of operation at the end of the overtime interval T.

Even when the lower second switch 102 is being short circuited out of operation by the moisture penetration and build-up, the upper first switch 101 functions properly because the first switch is positioned above the second switch 102 in the casing 1. The proper switch action of the first switch gnerates pulses S3 and S5 at times t0 and t1, respectively, and supplies them to the RS flip-flop 107, which, in turn, provides a control output S12 for the normal operation of the entire production line. The penetration of moisture into the switch casing may largely caused by failure in the water-tight seal for the switch device such as the packing ring 46 (FIG. 1B). In this sense, the trouble signal S13 and the LED's light signal generated by the moisture detecting unit 15 give warning on present failure of the water-tight seal.

The Second Embodiment

Figure 9:
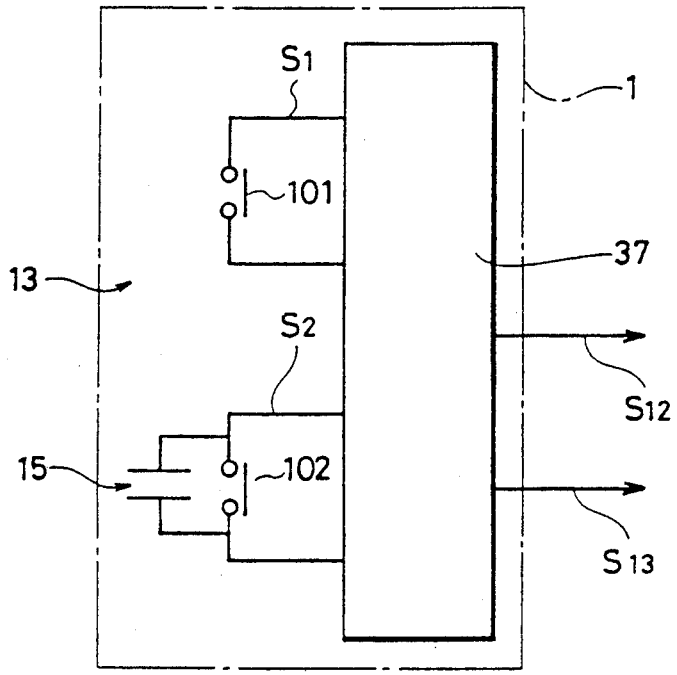
FIG. 9 is a schematic illustration showing the general structure of a switch device according to a second embodiment of this invention.

There is schematically illustrated in FIG. 9 a switch device according to another preferred embodiment of the invention. The switch device of FIG. 9 is essentially identical to the one of the preceding embodiment, and is shown comprising a mechanical switch assembly 13 and its associated circuitry 37, both of which are housed within the switch casing 1. The switch assembly is illustrated including a first switch 101, a second switch 102 and a moisture detector unit 15 electrically connected in parallel with the second switch. The switch movements of the first and second switch are under control of a common switch actuator (not shown) such as the actuator 4 in the preceding embodiment. The first and second switch 101 and 102 are simultaneously thrown into their open positions by the forward rotation of the actuator. During the backward rotation or return movement of the actuator, the first switch 101 is initially driven back to its closed position and, then, the second switch 102 is closed back with a predetermined delay. The moisture detecting unit 15 functions, upon sensing an excess ingress of moisture into the switch casing, to be closed and short circuit the second switch 102. The first switch 101 provides a high-level signals S1 to the switch circuit 37 while it is in the open position. Likewise, the second switch 102 supplies a high-level signal S2 to the switch circuit while in its open position. In the present embodiment, the switch circuit 37 is organized so that it generates a control output S12 as long as either of the first and second switches is being open. The circuitry 37 also feeds out a signal 13 indicating switch failure in response to the functioning moisture detector unit 15.

Figure 10:
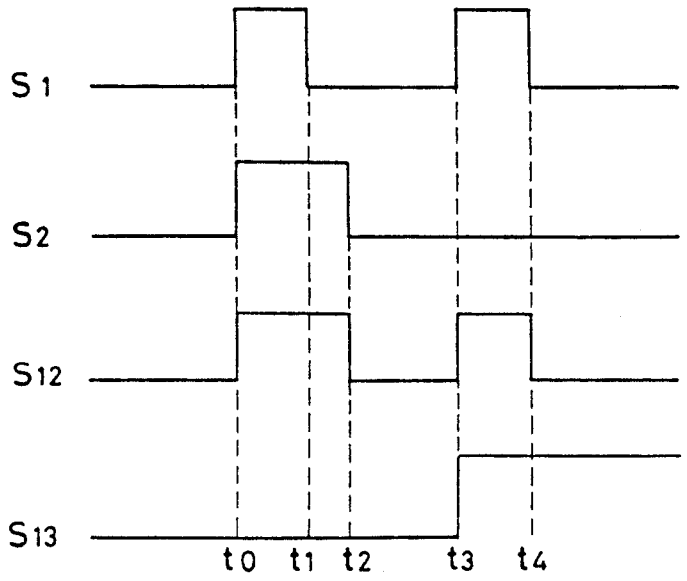
FIG. 10 is a timing diagram useful for understanding the operation of the switch circuit of FIG. 9.

The operation of the switch device is now described having reference to FIG. 10 where the waveforms of the signals are shown. Under normal condition, the first and second switches are thrown closed simultaneously by the switch actuator at time t0, the first switch supplying a high-level signal S1 to the switch circuit 37 and the second switch a similar high-level signal S2. During its return movement, the switch actuator throws the first switch 101 back to the closed position at t1, and then, the second switch 102 at t2 with a preselected delay of t1–t2. The closing of the first switch at t1 terminates the first switch signal S1, while the closing of the second switch at t2 terminates the second switch signal S2. As stated hereinabove, the switch circuit 37 functions to supply a high-level control output as long as either of the high level switch signals S1 and S2 is being applied thereto. Thus, as shown in FIG. 10, the circuit generate a high-level control signal S12 for t0—t2 which corresponds to the second switch signal S2. the signal S12, in turn, controls the operation of the production line or assembly line.

It is now assumed that the moisture detector unit 15 senses an excess moisture penetration and short circuit the second switch 102 after time t2. Under the circumstances, the first switch 101 is thrown open at t3, providing its signal S1 to the switch circuit. The second switch 102 is also thrown open simultaneously with the first switch. But it fails to generate the second switch signal such as S2 since the second switch has been short circuited by the moisture detector 15. The provision of the first switch signal S1 continues until time t4 when the first switch is closed back. In the absence of the second switch signal S2 having greater duration than the first switch signal S1, the switch circuit 37 produces a control output S12 during the time interval of t3—t4 in which the signal S1 is being applied to the circuit. The circuit 37 also senses the absence of the usual second switch signal S2 at t3 and functions to immediately produce a trouble indicating and warning signal S13.

In accordance with this embodiment, even when the second switch of the switch device is malfunctioning due to the presence of moisture within the switch casing, the remaining first switch is capable of normal operation independent of the faulty switch. And, as long as the remaining switch operates properly, the switch circuit functions to provide output signals for controlling the operation of the production line. The occurrence of malfunction in the switch device does not necessarily lead to an instant shut-down of the entire production line. The inspection and repair of the defective switch may be conducted, bringing the conduction cycle to a halt at a appropriate time.

The Third Embodiment

Figure 11:
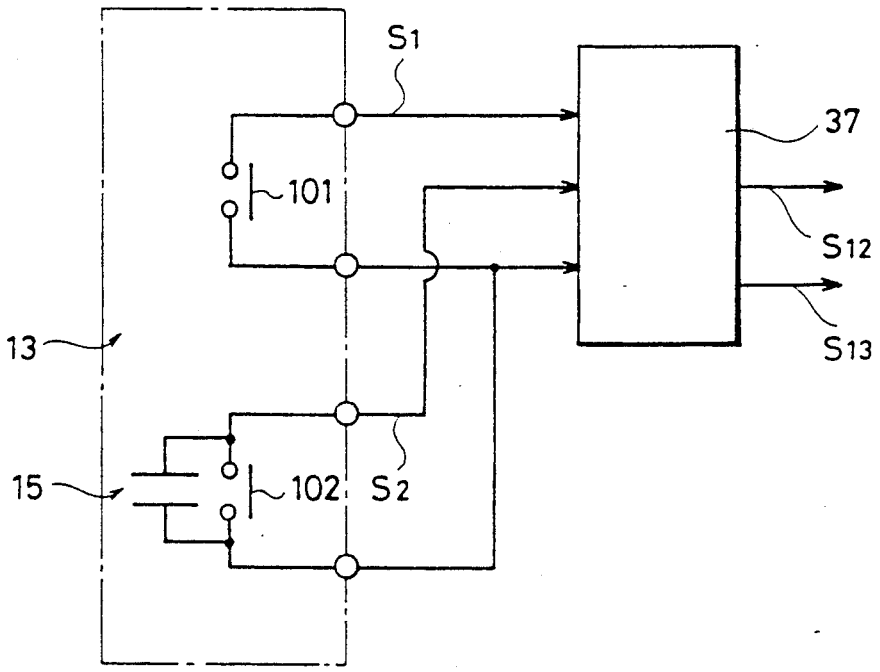
FIG. 11 is a schematic illustration showing the general structure of a switch device according to a third preferred embodiment.

A switch device according to still another embodiment of the invention is schematically illustrated in FIG. 11. The switch device of FIG. 11 is essentially identical in structure to that of FIG. 9 except that a switch circuit 37 is provided outside a switch casing 1 separate from a switch assembly. The switch assembly and its associated circuit of the switch device operate much the same way as that shown in FIG. 9. Thus no detailed description is given.

The Fourth Embodiment

In the preferred embodiments of the invention described hereinabove, the moisture detecting unit 15 has been provided in parallel with the second switch 102.

However, the invention is not limited thereto. In the embodiment shown in FIG. 12, the moisture detecting switch 15 is independent of the second switch 102.

Figure 12:
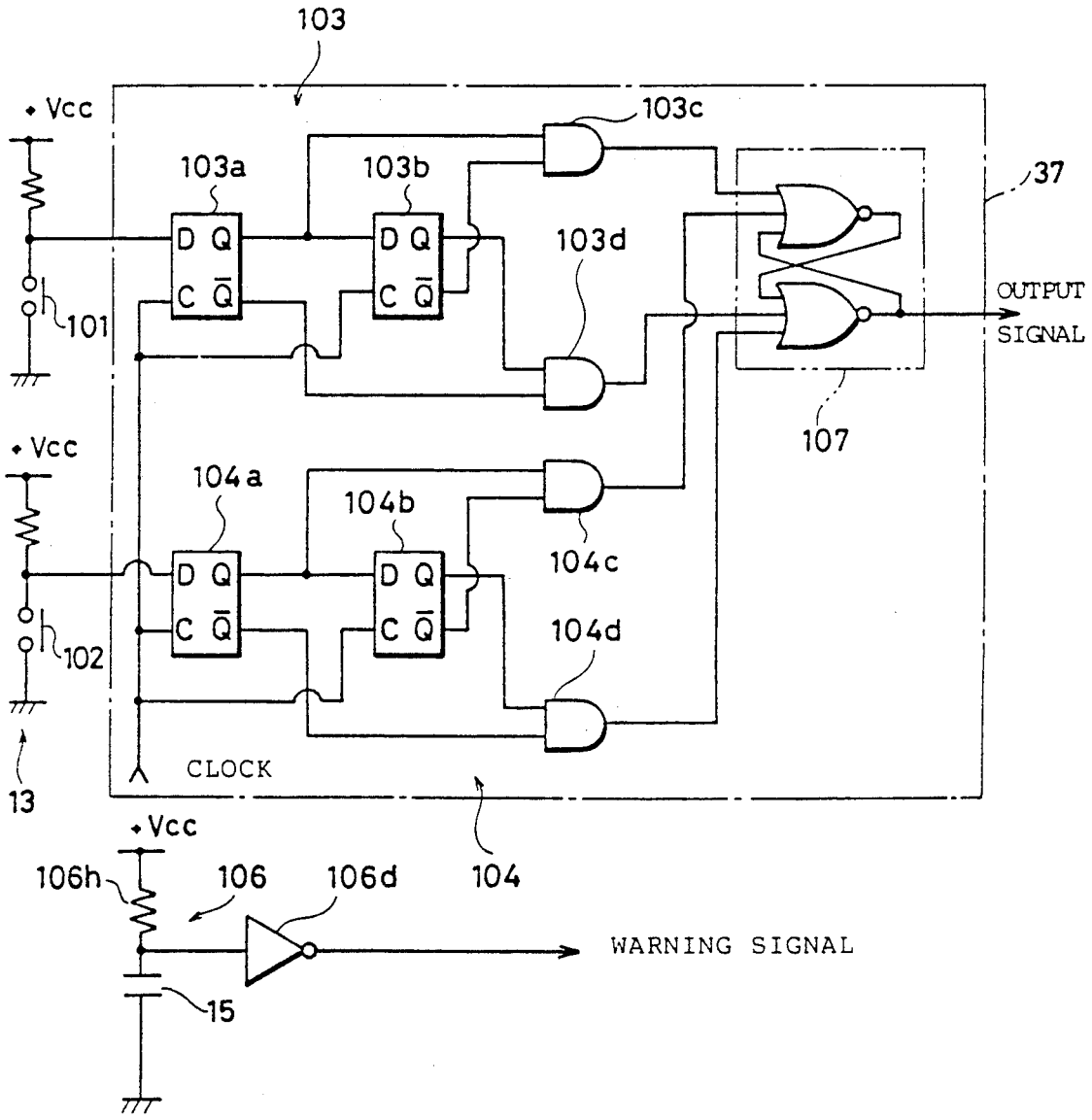
FIG. 12 is a schematic illustration showing the general structure of a switch device according to a fourth preferred embodiment of the invention.

Referring to FIG. 12, the first and second switch 101 and 102 are shown with its associated switch circuitry 37. The first input circuit 103 includes a D-type flip-flop 103*a* connected to the first switch 101 for receiving a switch signal therefrom. Another D-type flip-flop 103*b* is coupled to the preceding flip-flop 103*a*. AND gates 103*c* and 103*d* are connected to receive outputs from both flip-flops 103*a* and 103*b*. Coupled to the second switch 102 is a D-type flip-flop 104*a*, to which another D-type flip-flop 104*b* is connected. AND gates 104*c* and 104*d* are in circuit connection with the outputs of the flip-flops 104*a* and 104*b*. A RS-type flip-flop 107 is provided at the last stage of the switch circuitry 37 to receive outputs from all of the AND gates 103*c*, 103*d*, 104*c* and 104*d*. As in the previous embodiments, the first and second switches 101 and 102 are concurrently driven by the same switch actuator but they are of such design that, during the return trip from the open position to the closed position, the first switch initially closes followed by the second switch with a preselected delay time.

A moisture detecting switch 15 is provided in the vicinity of, but separately from the first and second switches 101 and 102. The moisture switch is electrically closed by excessive moisture or water penetrated into the switch device. The moisture detecting switch 15 also has an associated switch failure detecting circuit 106 which comprises a resistor 106*h* and an inverter 106*d*. The detecting circuit 106 produces a warning signal in response to the moisture switch being closed.

In operation of the switch circuitry 37, the first input circuit 103 provides an ON-OFF switch signal to the flip-flop 103*a* responsive to and indicative of the switch action of the first switch 101. The second input circuit 104 supplies a similar ON-OFF signal to its associated flip-flop 104*a*. AND gates 103*c* and 103*d*, upon simultaneously receiving outputs from both flip-flops 103*a* and 103*b*, feed output signals which represent ON-OFF switch actions of the first switch to the RS flip-flop 107. In a similar manner, AND gates 104*c* and 104*d* supply output signals representing ON-OFF motions of the second switch to the RS flip-flop 107. The RS flip-flop 107, thus produces output signals in response to the switching operation of the first and second switches 101 and 102. Meanwhile, as water finds its way into the switch casing, the moisture detecting switch 15 is closed and feeds a turn-on signal to the inverter 106*d*, which, in turn, generates a warning signals to indicate the adverse situation being caused.

With the circuit arrangement of FIG. 12, the first switch 101 and the second switch 102 forms a dual switch mechanism where each one switch backs up the other in case of operational failures. Thus, even when one of the switches breaks down the remaining one will take over the normal switching function.

While a moisture detector has been included in all of the embodiments described above, this invention is not limited to them. Following two embodiments in accordance with this invention do not have a moisture detecting and indicating mechanism.

The Fifth Embodiment

Figure 13:
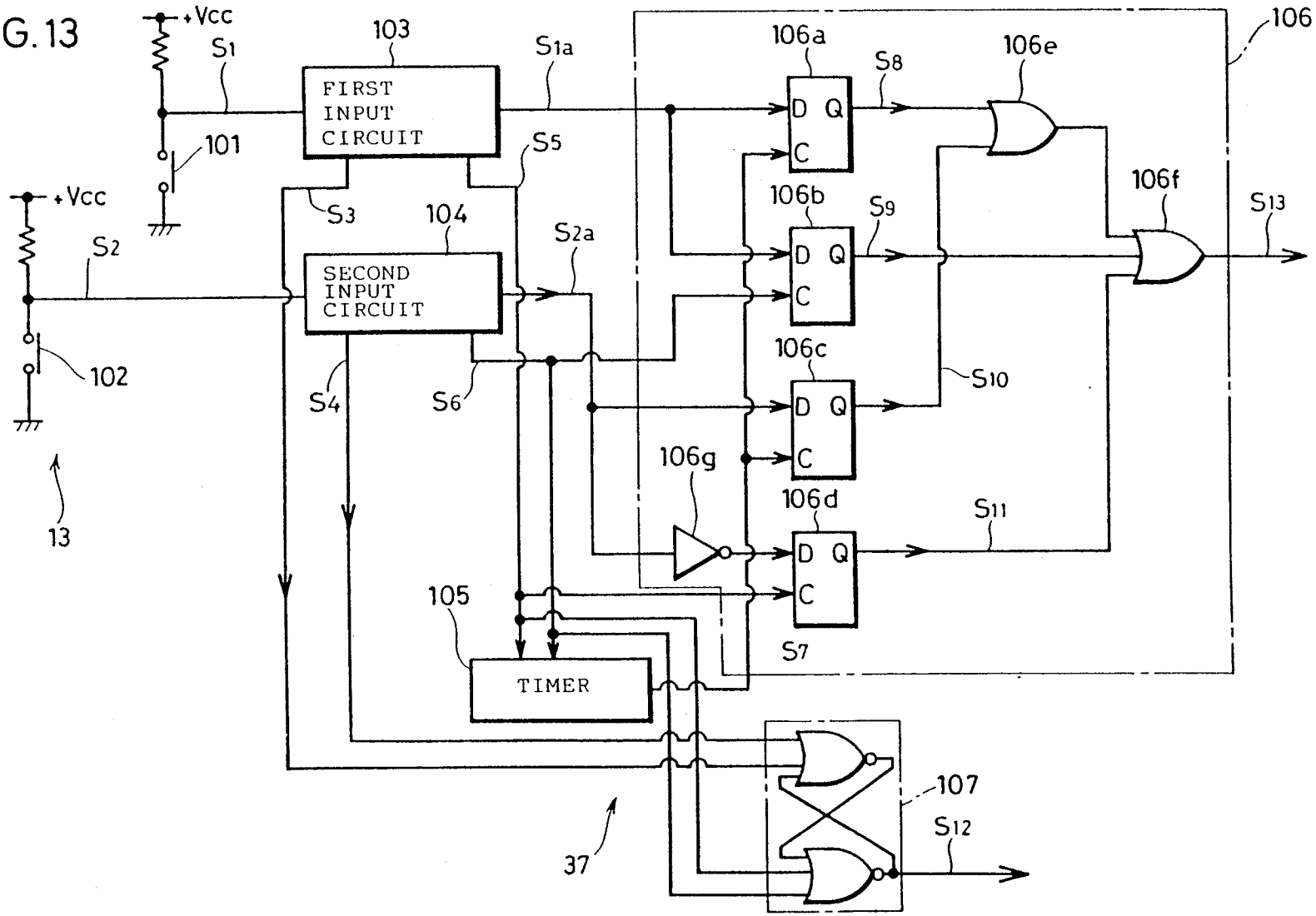
FIG. 13 is a schematic illustration showing the general structure of a switch device according to a fifth preferred embodiment of the invention.

Referring to FIG. 13, there is illustrated a switch circuitry together with a mechanical switch section for a switch device in accordance with another embodiment of the invention. The switch device is essentially similar in construction to those of the proceeding embodiment except that the present switch device includes no moisture detector as such. Thus, the control circuitry of FIG. 13 is identical to that shown in FIG. 7 except for the moisture detecting unit 15 provided in a parallel with the second switch 102. In the embodiment of FIG. 13, as moisture within the switch casing reaches to detrimental levels, the lower second switch 102 is short circuited. This situation is similar to that of the above-listed Non-normal Switch Operation III where the moisture build-up within the casing causes the moisture detector to form an electrical path bypassing the second switch. The circuitry of FIG. 13 functions much the same way as that of FIG. 7 in all the operating conditions or modes listed hereinabove. Thus, no detailed explanation is given.

The Sixth Embodiment

Figure 14:
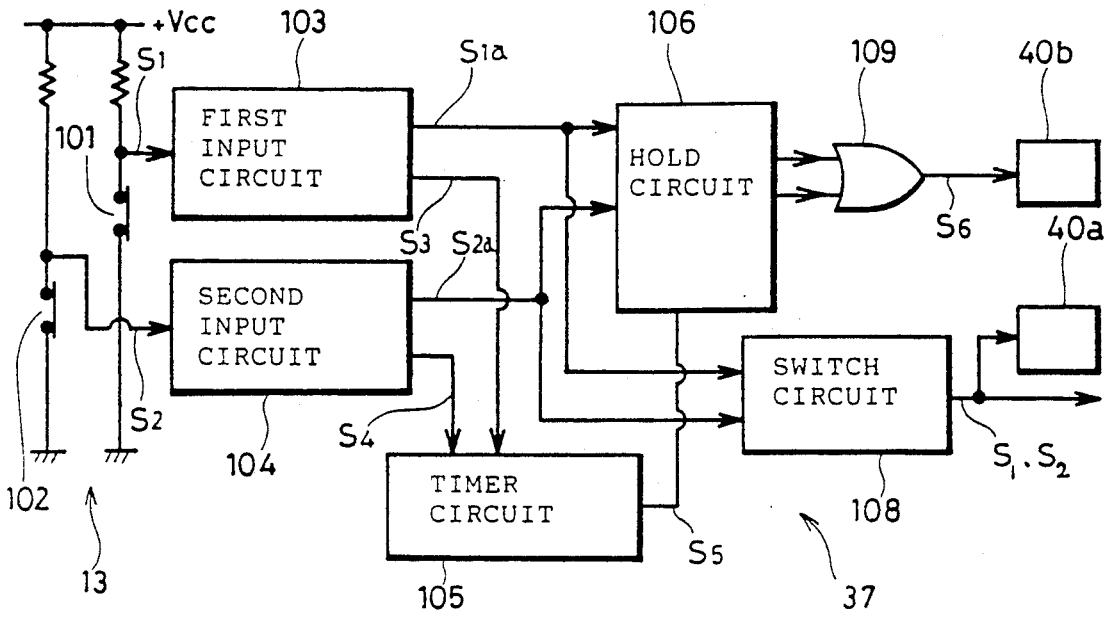
FIG. 14 is a schematic illustration showing the general structure of a switch device according to a sixth preferred embodiment of the invention.
Figure 15:
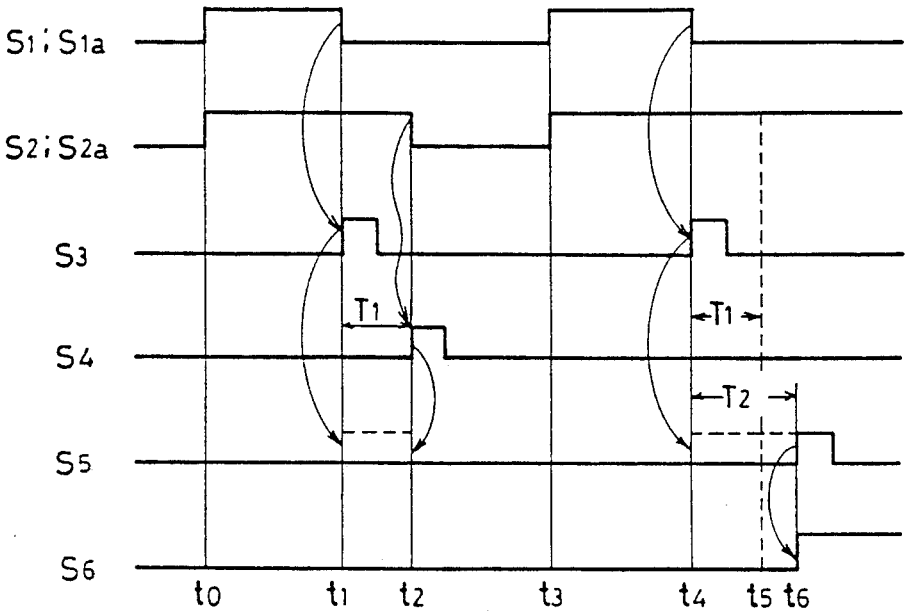
FIG. 15 is a timing diagram useful for understanding the operation of the switch circuit incorporated in a switch device of FIG. 14.

With reference to FIG. 14, the switch device according to a different embodiment of the invention is shown comprising a switch section and its associated circuitry. The function of the switch circuitry under normal and non-normal operating conditions with respect to the second switch 102 is now explained having also reference to FIG. 15.

Normal Switch Operation

Under normal switch operation, the first switch 101 opens at t0 and closes at t1, providing a switch signal S1 to the first input circuit 103 during the time interval t0–t1. The first input circuit 103 functions to generate a similar high-level signal S1*a* at its one output terminal for the time interval t0–t1. The first input circuit also produces a pulse signal S3 at its other output terminal at t1 upon sensing the termination of the switch signal S1. The output signal S1*a* is fed to a hold circuit 106 as well as to a switching circuit 108, whereas the output pulse S3 to a timer circuit 105. As before, the second switch 102 is thrown open simultaneously with the opening of the first switch 101. During the return movement, the second switch is normally thrown closed at t2 following the first switch being closed at t1. Thus, there is a delay of T1 in closing action between the first and second switches. As in the case of the first switch, the second switch 102 provides a switch signal S2 to the second input circuit 104 during the time interval of t0–t2 when it is open. The second input circuit 104, in turn, generates at its one output terminal a similar high-level signal S2*a* for the time interval of t0–t2, and at its other output terminal a pulse signal S4 at t2 when the switch signal S1 terminates. The high-level signal S2*a* is supplied both to the hold circuit 106 and the switching circuit 108, while the pulse signal S4 to the timer circuit 105. Consequently, the switching circuit 108 functions to produce a switching signal $S_1$ during the time interval t0–t1 and a switching signal $S_2$ during the time interval t0–t2.

The timer circuit 105 is triggered into operation at t1 by the clock pulse S3 and out of operation at t2 by the clock pulse S4. Also as before, the timer circuit 105 has an overtime operating cycle T2 which is preselected to be greater in duration than the delay time T1 between the closing actions of the first and second switches. Thus, under the normal operation, the timer circuit does not produce an overtime signal such as signal S5. In the absence of the overtime signal S5, the hold circuit 106 fails to hold the output signals S1*a* and S2*a* from the first and second input circuits 103 and 104. Accordingly, no warning signal appears at the output terminal of an OR gate 109 connected to the hold circuit 106.

Non-Normal Operation

The Second Switch Fails to Return

Returning failure of the second switch including an overdue return movement may result from unfavorable conditions pertaining to the switch actuator and/or the internal switch mechanism itself as set forth previously. Take a situation, for example, where the switch actuator 4 is brought to a halt during its return stroke after it has tripped the first switch back but before tripping the second switch back. The first switch 101 is normally opened at t2 and closed at t4, while the second switch 102 also normally opens at t3 but fails to close back at t5 for the reasons just stated. Under the circumstances, the timer circuit 105, while having been triggered by the clock pulse S3 at t4, keeps its operating cycle beyond the preselected delay time T1 in the absence of the clock pulse S4. Upon the lapse of the greater overtime interval T2, the timer circuit 105 generates an overtime signal S5 at t6, which is supplied to the hold circuit 106. The application of the overtime signal S5 allows the hold circuit 106 to keep the output signals S1*a* and S2*a* from the first and second input circuits and provide corresponding outputs to the OR gate 109. Then, the OR gate 109 functions to generates a trouble indicating signal S6, by which the LED 40*b* is rendered conductive to provide a visible warning.

As hereinabove described in detail, a novel electromechanical switch has been provided in accordance with the invention which is particularly suitable for use in a factory production or assembly line to detect and control the flow of various workpieces and other articles of manufacture along the line. The dual switch arrangement allows the switch device not only to detect and indicate mechanical failures of the switch such as the failure of the switch return movement and the switch contact failure in their earliest stages but also to keep its uninterrupted operation in the face of these malfunctions. Thus, the occurrence of mechanical troubles in the switch device neither causes nor necessitates an instant or immediate shut-down of the production line, which inevitably disrupts the entire manufacturing activities of the factory. The production line is allowed to run for some time until it is brought to a halt for the inspection and repair of the faulty switch device at an appropriate time when it is considered to least affect the production and manufacturing operation, for example, during the nighttime suspension. A shut-down frequency of an assembly or production line equipped with the switch device of the invention will be drastically reduced, boosting production efficiency and cutting overall manufacturing costs. Undesirable penetration of moisture into the switch device is also detected and an early warning is given without, however, causing an instant shut-down of the production line as in the case of the mechanical failures.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A switch device having a trouble detecting and indicating function comprising:

a casing;

first switch means provided within said casing and externally operated between open and closed positions;

second switch means provided within said casing and externally operated jointly with said first switch means between open and closed positions;

first circuit means for providing an output signal responsive to the operation of said first switch means;

second circuit means for providing an output signal responsive to the operation of said second switch means;

means positioned within said casing for detecting moisture therein and providing an output signal upon detecting moisture; and means for providing a warning signal in response to the output signal from said moisture detecting means;

wherein said means for detecting moisture comprises switch means electrically connected in parallel with said second switch means and adapted to be short circuited by the moisture trapped within said casing.

2. A switch device having a trouble detecting and indicating function according to claim 1, wherein said means for providing a warning signal is electrically connected to said first circuit means and second circuit means, and is adapted to provide a warning signal upon receiving an output signal from said first circuit means without receiving an output signal from said second circuit means.

3. A switch device having a trouble detecting and indicating function according to claim 1 further comprising means for providing a control signal responsive to the operation of either of said first switch means and second switch means.

4. A switch device having a trouble detecting and indicating function comprising:

a casing;

first switch means provided within said casing and externally operated between open and closed positions:

second switch means provided within said casing and externally operated jointly with said first switch means between open and closed positions;

first circuit means for providing an output signal responsive to the operation of said first switch means;

second circuit means for providing an output signal responsive to the operation of said second switch means;

means positioned within said casing for detecting moisture therein and providing an output signal upon detecting moisture; and means for providing a warning signal in response to the output signal from said moisture detecting means;

wherein said means for detecting moisture comprises switch means electrically independent from said second switch means and adapted to be short circuited by the moisture trapped within said casing.

* * * * *